United States Patent [19]

Punako et al.

[11] Patent Number: 4,632,482

[45] Date of Patent: Dec. 30, 1986

[54] CONTACT FOR AN ELECTRICAL CONNECTOR

[75] Inventors: Stephen Punako, Bainbridge; David O. Gallusser, Oneonta; Carl R. Joslyn, Unadilla, all of N.Y.

[73] Assignee: Allied Corporation, Morristown, N.J.

[21] Appl. No.: 750,646

[22] Filed: Jun. 28, 1985

Related U.S. Application Data

[63] Continuation of Ser. No. 402,524, Jul. 28, 1982, abandoned, which is a continuation-in-part of Ser. No. 368,594, Apr. 15, 1982, Pat. No. 4,447,110.

[51] Int. Cl.[4] ..... H01R 13/44

[52] U.S. Cl. ..... 339/59 M; 339/94 M; 339/217 S

[58] Field of Search ..... 339/217 S, 252 R, 252 P, 339/94 M, 94 R, 94 A, 94 C, 59 M, 59 R

[56] References Cited

U.S. PATENT DOCUMENTS

| | | | |
|---|---|---|---|
| 2,758,291 | 8/1956 | Richards | 339/94 R |
| 2,881,406 | 4/1959 | Arson | 339/59 M |
| 3,101,229 | 8/1963 | Yopp | 335/59 M |
| 3,144,208 | 8/1964 | Grant | 339/94 M |
| 3,165,309 | 1/1965 | Maston | 339/59 M |
| 3,171,887 | 3/1965 | Cross et al. | 339/94 M X |
| 3,221,292 | 11/1965 | Swanson et al. | 339/217 S |
| 3,255,427 | 6/1966 | Yeiser | 339/94 R |
| 3,334,327 | 8/1967 | Anspach, Jr. | 339/217 S |
| 3,638,165 | 1/1972 | Anhalt | 339/217 S X |
| 3,693,140 | 9/1972 | Nijman | 339/252 P |

FOREIGN PATENT DOCUMENTS

| | | | |
|---|---|---|---|
| 1156466 | 10/1963 | Fed. Rep. of Germany | 339/94 M |
| 669986 | 10/1964 | Italy | 339/217 S |
| 1454980 | 11/1976 | United Kingdom | 339/59 M |
| 2095484 | 9/1982 | United Kingdom | 339/59 M |
| 474876 | 10/1975 | U.S.S.R. | 339/94 M |

*Primary Examiner*—William R. Briggs

*Attorney, Agent, or Firm*—R. J. Eifler; C. D. Lacina

[57] ABSTRACT

This invention relates to an electrical connector that has insertable and removable contacts (20) retained and sealed against moisture by a one piece molded rubber insert (30). The invention is characterized by a contact (20) having two annular grooves (24, 25) formed by acutely angled flat surfaces (26, 27) that are adapted to mate with flat surfaces (36, 37) from corresponding wall portions (32, 33) of a complementary shaped bore (31) in a molded rubber insert (30).

3 Claims, 2 Drawing Figures

CONTACT FOR AN ELECTRICAL CONNECTOR

This application is a continuation of application Ser. No. 402,524 filed July 28, 1982, now abondoned, which is a continuation-in-part of U.S. patent application Ser. No. 368,594 entitled "Socket Contact for an Electrical Connector" and filed Apr. 15, 1982 now U.S. Pat. No. 4,447,110.

This invention relates to an electrical connector and more particularly to an electrical contact mounted within the connector.

Electrical connectors generally include a plug and receptacle, each of which has an insert of dielectric material provided with multiple openings within which electrical contacts are retained. The insert is introduced into the rear end of a metal shell or housing of the connector where it is held in place by some means, such as a nut. Some connectors provide for rearward insertion and front or rear release of electrical contacts, while other connectors provide for front insertion and front or rear release of electrical contacts. These feature are desirable and facilitate the assembly and servicing of the connector. Examples of a prior art electrical connector having insertable and removable contacts may be found in U.S. Pat. Nos. 3,165,369 entitled "Retention System for Electrical Contacts" issued July 12, 1966; and 3,221,292 entitled "Electrical Connector" issued Nov. 30, 1965. In the foregoing patents, the contacts are retained within the connector housing by a retention mechanism and the contacts are sealed from moisture by a separate rubber grommet which fits tightly around the incoming wires to prevent moisture from entering into the area between the contacts. Generally, where removable contacts and a moisture seal is required three or more parts were sandwiched together to accomplish these functions.

DISCLOSURE OF THE INVENTION

This invention provides an electrical connector that has insertable and removable contacts retained and sealed against moisture by a one piece molded rubber insert. The invention is characterized by a contact having two annular grooves formed by acutely angled flat surfaces that are adapted to mate with a complementary shaped bore in a rubber insert.

Accordingly, it is an advantage of this invention to provide an insert for an electrical connector that combines the contact retaining functions and moisture sealing functions into a single intergral part.

It is also an advantage of this invention to eliminate the need to sandwich two or more parts together to accomplish the retention and moisture sealing of a contact with an electrical connector.

It is another advantage of this invention to decrease the cost of assembling an electrical connector.

It is another advantage of this invention to eliminate the need for adhesives to seal the mulitple parts that made up a prior art connector insert.

DETAILED DESCRIPTION OF THE INVENTION

Figure 1:
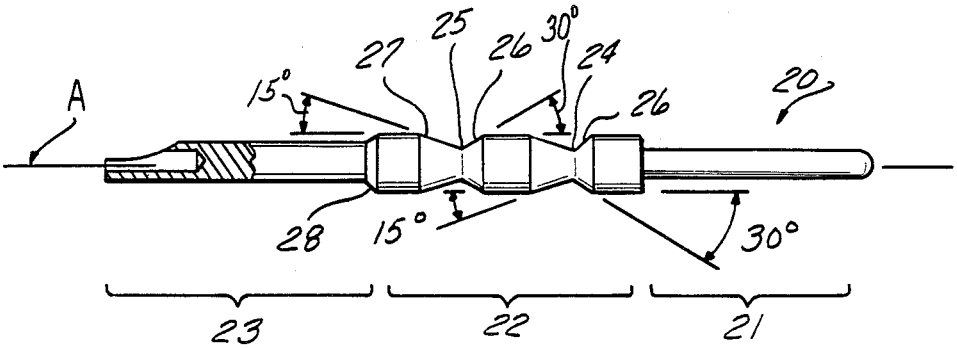
FIG. 1 illustrates an electrical contact.

Referring now to the drawing, FIG. 1 illustrates a pin-type electrical contact 20 having a central axis A, a forward mating portion 21, an intermediate portion 22 and a rear wire receiving portion 23. The intermediate portion 22 includes two grooves 24 and 25. Each groove 24, 25 includes acutely angled flat surfaces 26, 27. The forward angled surface 26 is at an angle of about 30 degrees from the central axis of the contact. The surface 27 rearward of the forward surface 26 is at an angle of about 15 degrees from the central axis of the contact 20. A rearwardly facing shoulder 28 is located between the intermediate portion 22 and end portion 23. The angle of the surfaces 26, 27 are designed in this embodiment to require a lower removal force from the insert 30 than insertion force. The angles could be reversed if a reverse result is desired, i.e., higher removal force.

Figure 2:
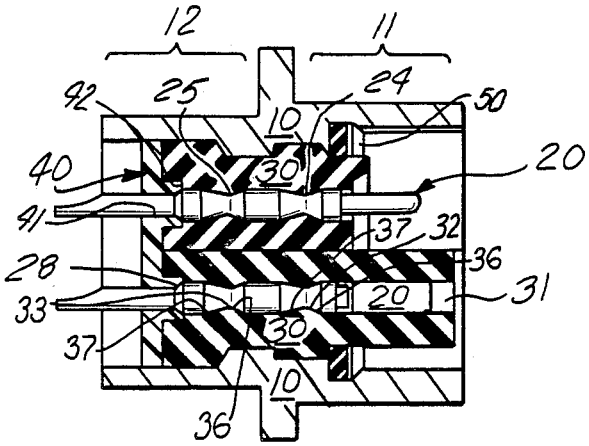
FIG. 2 is a diagrammatic view of an electrical connector incorporating the principles of the invention.

FIG. 2 is a diagrammatic view of an electrical connector incorporating the principles of the invention. The electrical connector includes a metal housing 10, a dielectric insert 30 having mounted therein a male pin-type contact 20 or a female socket-type contact 20, a rearward plate 40, and a forward plate 50. Each insert 30 includes a bore 31 having mounted therein a respective contact 20. Each of the bores 31 in the insert 30 includes two radially inwardly projecting wall portions 32 and 33 (or restrictions) that mate, respectively, with the annular grooves 24, 25 in the contact 20. Each wall portion includes acutely angled flat surfaces 36, 37 which mate against the respective surfaces 26, 27 of each of the corresponding grooves 24, 25. Each bore 31 has an inner diameter that is slightly less than the outside diameter of the contact 20 so as to provide a pressure tight seal around the contact. The angle of the surfaces 26, 27 of each of the grooves 24, 25 determine the retention strength of the contact when it is inserted into the insert 30. By changing the angle of the surfaces 26, 27 and their corresponding surfaces 36, 37, the force required to insert and remove the contact 20 from the insert 30 can be changed. To prevent further rearward movement of a contact 20 mounted in the connector insert 30 the plate 40, comprised of a hard dielectric material, is fixedly mounted within the housing 10. The plate 40 has a bore 41 therethrough which receives the rear portion of the contact and includes a tower 42 which seats in the dielectric 30. The rear shoulder 28 of the contact 20 abuts against a forwardly facing shoulder 43 from the lower 42 on the plate 40 to prevent further rearward movement of the contact 20 in the insert 30. The plate 40 acts as a positive stop when a contact 20 is inserted into the bore 31 of the insert 30 from the front of the connector housing 10. The insert 30 is comprised of an elastomer such as rubber and preferably has a durometer of about 65.

While a preferred embodiment of the invention has been disclosed, it will be apparent to those skilled in the art that changes may be made to the invention as set forth in the appended claims and, in some instances, certain features of the invention may be used to advantage without corresponding use of other features. For instance, there could be one groove instead of two grooves in each contact 20 and the angle of the surfaces 26, 27 could be the same. Accordingly, it is intended that the illustrative and descriptive materials herein be used to limit the principles of the invention and not to limit the scope thereof.

Having described the invention, what is claimed is:

1. In combination with an electrical connector of the type including: a housing having a forward portion and a rearward portion; a plurality of elongated electrical cylindrical contacts with each having a forward mating portion, an intermediate mounting portion and a rearward wire receiving portion; and means for releasably mounting said contacts in said housing including an insert having a plurality of cylindrical bores therin, each said bore having a central portion for receiving the mounting portion of a respective contact, the improvement wherein:

the connector includes a dielectric plate having a tower extending therefrom and seated in the insert, each contact includes a rearwardly facing shoulder that is abuttable against a face of the tower and the intermediate mounting portion of each said contact has two longitudinally spaced annular grooves and the central portion of each said bore has two longitudinally spaced and radially inwardly projecting wall portions with each said wall portion being adapted to seat within one respective annular groove, each said groove having a first surface facing rearwardly and a second surface facing forwardly with each of said surfaces being acutely angled from the central axis of said contact with the angle of the first surface and the second surface, respectively, being about 30° and 15° from the central axis of said contact, each said wall portion having a first mating surface and a second mating surface with the first and second mating surfaces being acutely angled to engage, respectively, with the first and second surface of one said annular groove, and each said bore in said insert has a diameter less than that of said contact.

2. The combination as recited in claim 1 wherein the angle of the first surface is smaller than the angle of the second surface whereby the contact requires a higher removal force than insertion force.

3. The combination as recited in claims 1 or 2 wherein the insert is comprised of a rubber having a durometer of about 65.

* * * * *